United States Patent [19]

Croley

[11] 3,972,454

[45] Aug. 3, 1976

[54] DRUM-LIKE FIBERBOARD CONTAINER FOR BULK MATERIAL WITH FRANGIBLE BOTTOM CLOSURE FOR DISPENSING

[75] Inventor: Thomas E. Croley, Worthington, Ohio

[73] Assignee: Comco, Inc., Worthington, Ohio

[22] Filed: July 31, 1975

[21] Appl. No.: 600,836

[52] U.S. Cl. ..... 222/541; 229/7 R; 229/17 B; 229/51 D; 214/304

[51] Int. Cl.[2] ..... B65D 47/10

[58] Field of Search ..... 222/180, 181, 185, 184, 222/541; 229/7 R, 51 D, 17 B, 51 S; 214/304, 307, 305

[56] References Cited

UNITED STATES PATENTS 2,357,093 8/1944 Main et al. ..... 229/7 R 3,348,738 10/1967 Hertlein ..... 214/305

FOREIGN PATENTS OR APPLICATIONS 705,757 3/1965 Canada ..... 229/7 R

*Primary Examiner*—Robert B. Reeves
*Assistant Examiner*—H. Grant Skaggs
*Attorney, Agent, or Firm*—William V. Miller

[57] ABSTRACT

A drum-like container of fiberboard or similar material supplied in flat knocked-down form and adapted to be set up to serve both as a shipping and dispensing container for bulk material which is provided with a bottom closure equipped with a frangible wall arrangement to permit opening readily for dispensing the container contents.

16 Claims, 9 Drawing Figures

DRUM-LIKE FIBERBOARD CONTAINER FOR BULK MATERIAL WITH FRANGIBLE BOTTOM CLOSURE FOR DISPENSING

BACKGROUND OF THE INVENTION

Large fiberboard drum-like containers for shipping and storing bulk loose material have been provided in the past. However, in most cases these containers are difficult to handle to pour the contents therefrom and usually it is necessary to have special equipment to tilt them or to suck out the contents.

SUMMARY OF THE INVENTION

To facilitate emptying fiberboard drum-like containers of the type indicated, the present invention provides a lower closure wall or bottom which is scored and perforated to provide a frangible wall with flaps that are normally joined together in a flat plane to provide the bottom but which are so arranged that the wall can be ruptured to permit swinging of the flaps downwardly to provide a dispensing opening. Tear-strips are provided on the bottom wall and include tab-portions which can be gripped to rupture the wall to provide the dispensing opening.

The present invention is particularly applicable to a drum-like container structure of the type disclosed in my U.S. Pat. No. 3,563,448 and will be described in this application with specific reference to that structure by way of example.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
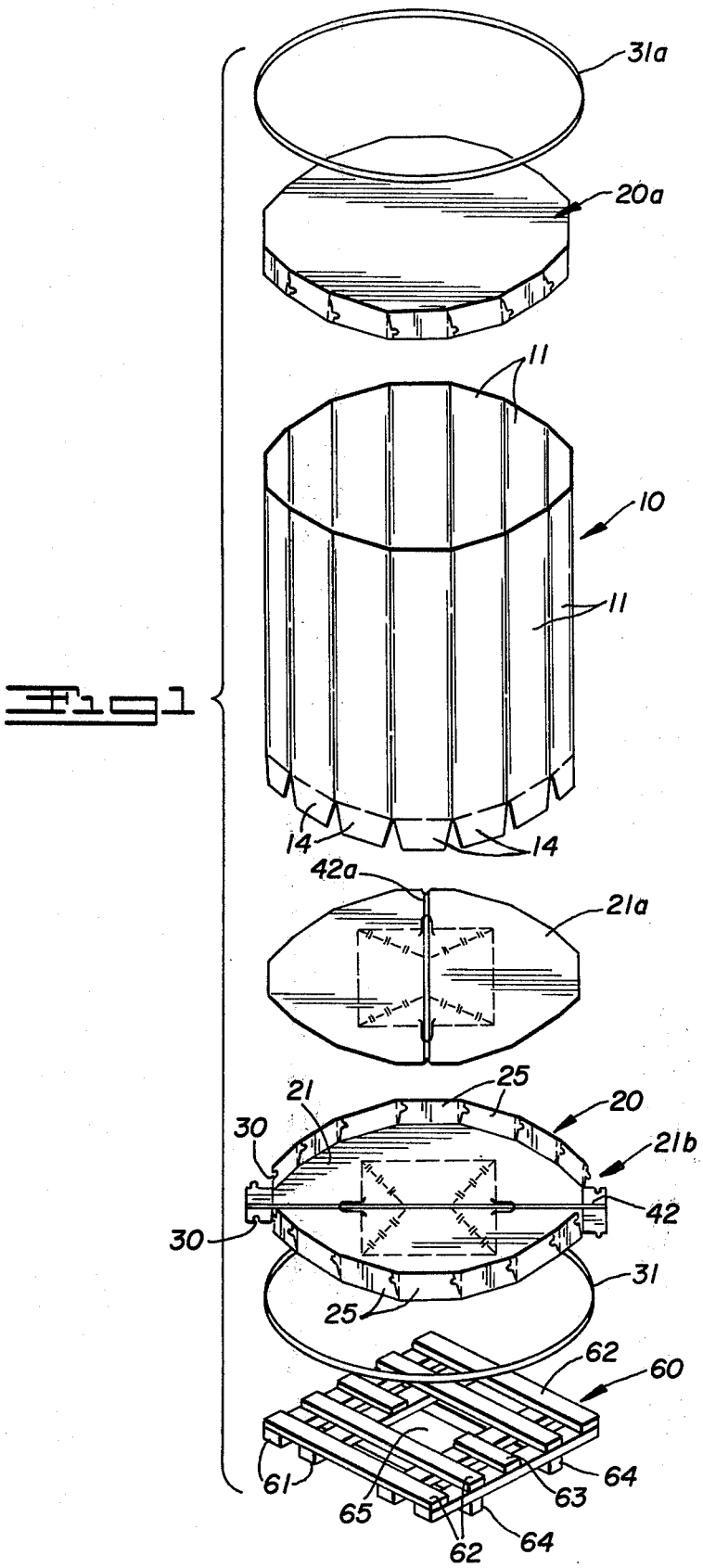
FIG. 1 is an exploded perspective view of a shipping and dispensing container embodying this invention.

As indicated, this invention is shown as being incorporated in a drum-like container of the type disclosed in U.S. Pat. No. 3,563,448. This drum is of the type which is supplied in flat knocked-down form for setting up into a substantially cylindrical form which, however, has a tubular body of horizontal polygonal cross-section due to the fact that it is composed of a series of vertical panels hinged together. Thus, in FIG. 1 of the drawings, the body is shown generally at 10 and consists of the joined vertical panels 11 with depending flanges 14 at the lower ends of the respective panels. The top closure may be of any suitable type but in the drawings is shown as a cap 20*a* which can be formed exactly as disclosed in said patent and can be held in place by a suitable retaining band 31*a*. The lower closure structure is of special form according to this invention and is indicated generally by the numeral 20 (FIGS. 2 and 3). It cooperates with the in-turned flanges 14 at the lower end of the body 10. A suitable retaining band 31 aids in connecting the assembly 20 to the tubular body 10. As will be explained later, the bottom closure includes the inner flat bottom wall or liner 21*a* and the outer cap 21*b* which has a flat bottom wall. These various parts are shown in disassembled relationship in FIG. 1 along with a skid 60 which is of a type suitable to support the container assembly during shipping and dispensing.

As indicated above, the bottom closure assembly includes the outer or bottom tray 21*b* which is mainly of disc-like form and the inner disc-like wall 21*a*. The overall construction of the outer bottom or tray 21*b* is like the container end structure disclosed specifically in said patent. It comprises (FIG. 4) a flat, substantially disc-like wall 21, but which has an outer peripheral edge of polygonal outline where the score or hinge lines 22 connect to the attaching flanges 25.

Each flange 25 at one of its lateral edges is provided with a triangular tab 26 which is hinged to that edge along a scoreline 27 and which on its other free angularly disposed edge 29 is provided with a lateral extension ear 28. The opposite lateral edge 29 of each flange is provided with a band-receiving notch 30 spaced outwardly from the scoreline 22.

Figure 2:
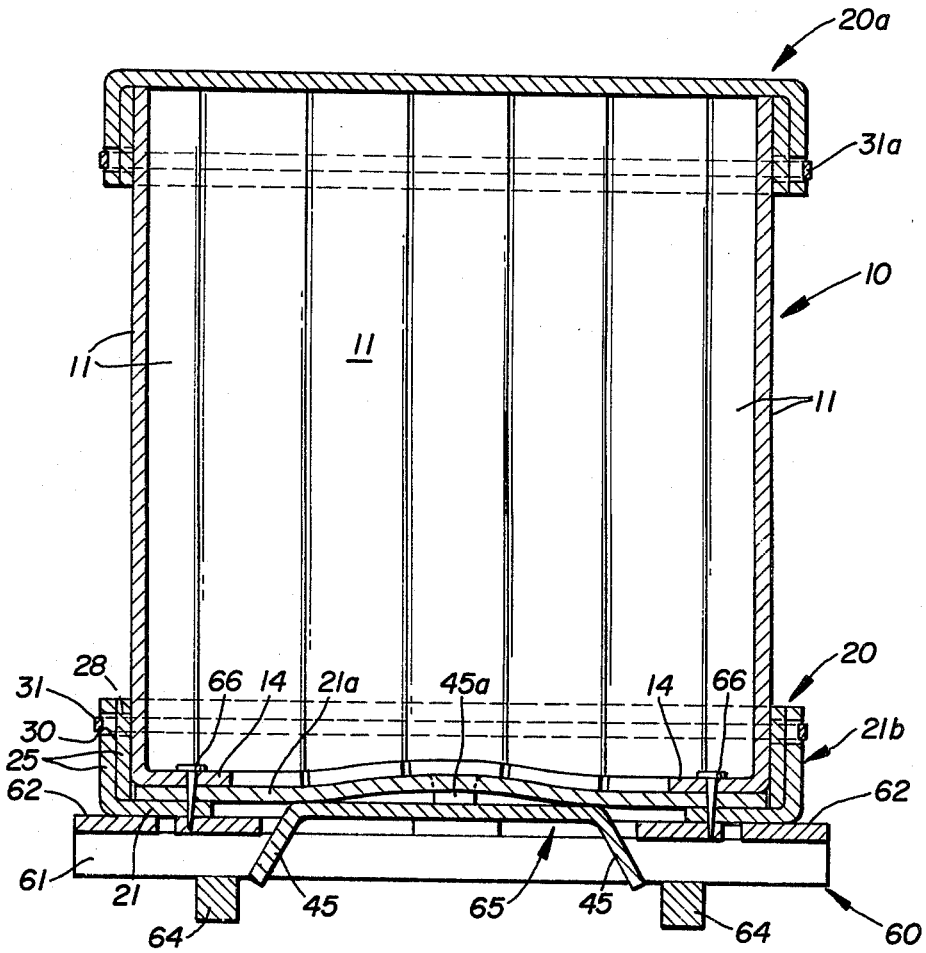
FIG. 2 is a vertical sectional view through the assembled container and supporting pallet, with the bottom flaps in normal closed condition.
Figure 3:
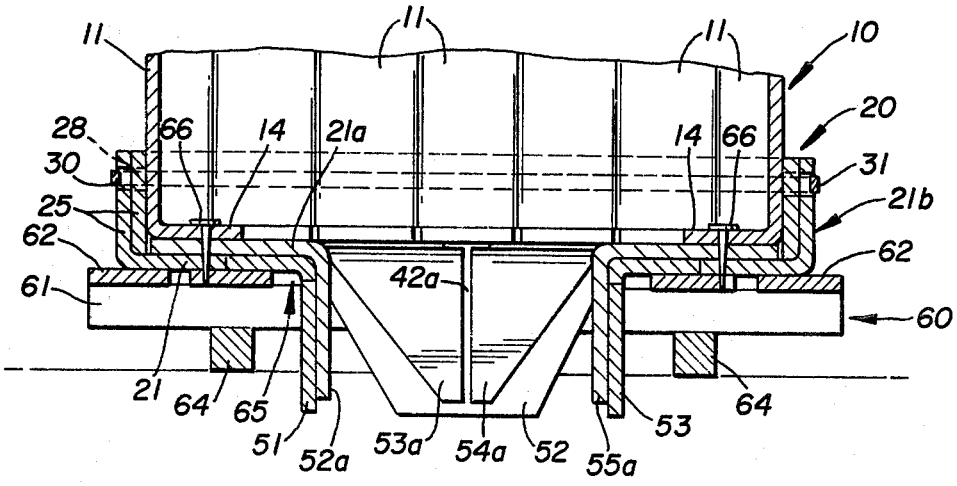
FIG. 3 is a similar fragmentary sectional view but showing the bottom opened for dispensing.

The flanges 25 are folded successively inwardly or upwardly relative to the disc-like wall 21, as indicated in FIGS. 1 to 3, so that the triangular tab 26 of the one flange will be inwardly of the edge 29 of the next flange. This will expose the notches 30 on the edges 29 of successive flanges. These notches are spaced from the free outer edges 32 of the flanges 25. The area of the wall 21 will be slightly greater than the cross-sectional area of the tubular body 10 so that the lower end of the body 10 can be inserted within the upward flanges 25 which will be disposed just outside the planes of the side panels 11 and in flat contact with the exterior surfaces of those panels (FIGS. 2 and 3).

The disc-like wall 21*a* also forms part of the bottom closure assembly 20 and is substantially like the disc-like wall 21 of the cap 21*b*. However, it is of slightly less area so that it can be inserted within the upturned flanges 25 of bottom tray 21*b* and it has a polygonal outer edge 25*a* which will snugly engage the inner faces of the flanges 25 when it is inserted in the bottom tray so as to rest on the outer bottom wall 21 (FIGS. 2 and 3).

As previously indicated, the bottom closure assembly 20 is made frangible so that it can be readily ruptured to form a dispensing opening. It will be apparent that since the bottom assembly includes an outer or lower bottom wall 21 and an overlying upper wall 21*a*, both walls must be made frangible so that the lowermost wall can first be ruptured and then the upper wall can be ruptured to provide, successively, aligning openings which will, together, constitute the dispensing opening in the bottom of the drum. The arrangement which makes this possible for the bottom tray 21*b* is illustrated in FIG. 4 and the arrangement which makes this possible for the inner wall 21*a* is illustrated in FIG. 5.

Figure 4:
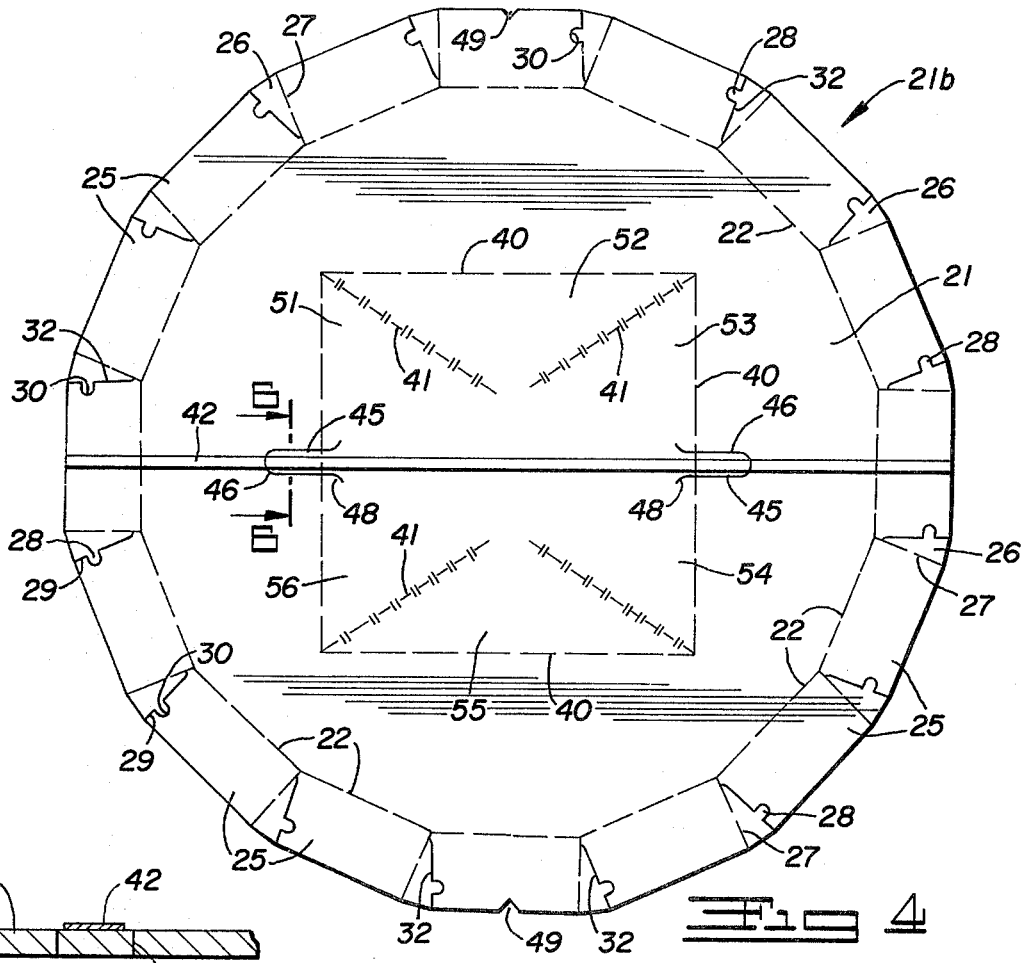
FIG. 4 is a plan view of the outer tray used in the bottom closure according to this invention.
Figure 6:
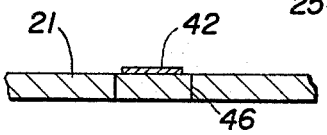
FIG. 6 is an enlarged sectional view taken along line 6—6 of FIG. 4 or 5.

With reference to FIG. 4 which shows the cap blank flat, the frangible arrangement in wall 21 is shown as including score lines 40, in the form of a square, which will serve as hinge lines for downwardly swinging flaps to be subsequently formed. Inwardly-extending from each corner of the square 40 are angular perforated lines or joints 41. The lines 41 converge towards a diametrically extending tear-line indicated at 42 which bisects the square but there is no actual score or weakened line at this point. At this tear-line, on the inner or upper surface of the wall 21, a tear tape 42 is provided which may be filament-containing tear-tape of a common type. The strip 42 may extend completely across the cap 21*b*. Tab-forming diecuts 46 are provided downwardly through the tape strip 42 and the underlying disc 21 to form pull-tabs 45. These tabs are at each side of the square 40, at the tear line 42, and extend radially outwardly from the square, being provided with lateral hinge cuts 48 at their inner ends. Tearing the wall 21 at the tear-line 42, by tabs 48 and at the perforated lines 41 would obviously produce the six flaps 51, 52, 53, 53, 55 and 56 hinged at the respective sides of the scored square 40. Orienting notches 49 are provided in the peripheral edge of the flat blank at opposed points along a diametric line at a right angle to the diametrically extending tear line 42.

Figure 5:
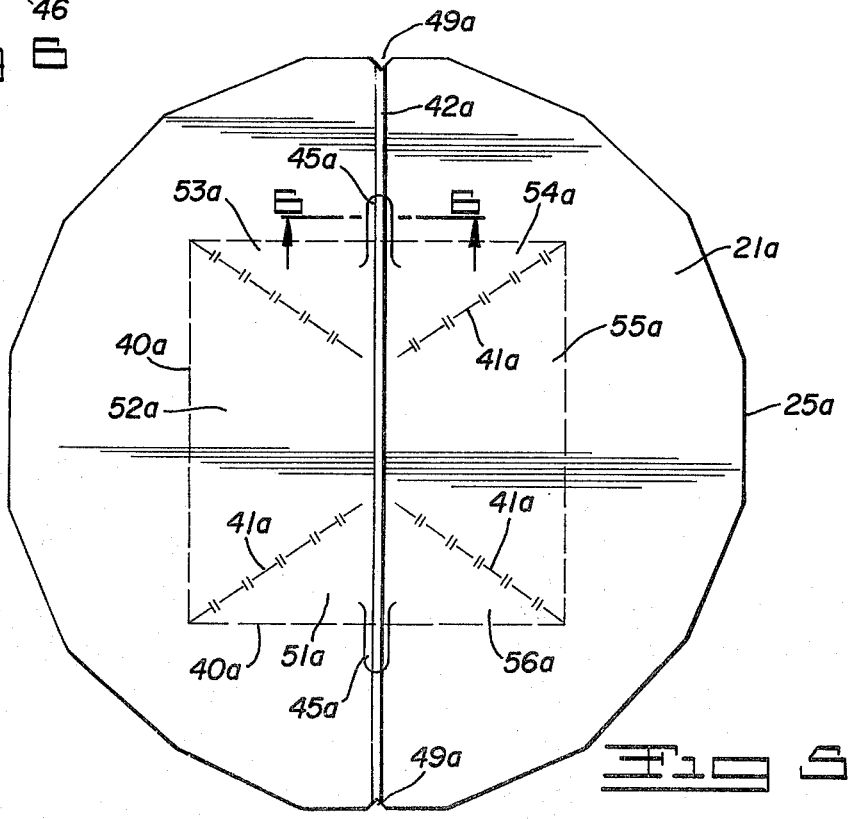
FIG. 5 is a plan view of an inner bottom wall or liner used in the bottom closure according to this invention.
Figure 7:
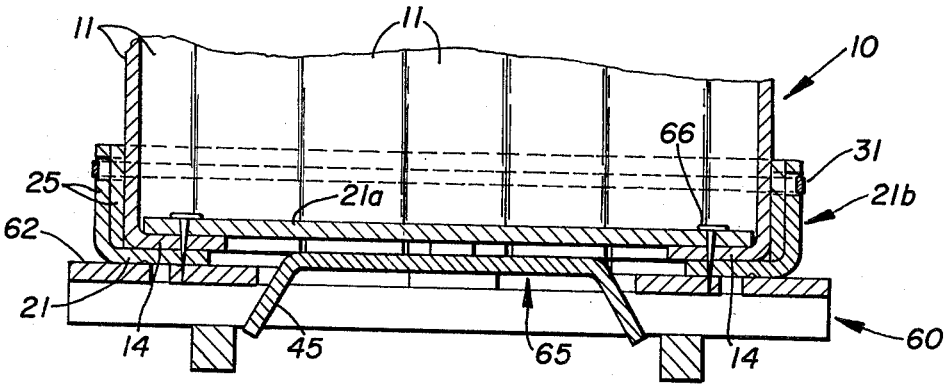
FIGS. 7 to 9 are similar to FIG. 2 but show additional bottom closure arrangements.

With reference to FIG. 5, which shows the inner or liner bottom wall 21*a*, the frangible arrangement is shown similar to that of bottom tray 21*b*, and comprises the square score line 40*a*, the perforated angular lines 41*a*, the diametrically extending tear-strip 42*a*, and the pull tabs 45*a*. Orienting notches 49*a* are provided in the peripheral edge of wall 21*a* at diametrically opposed points at the tear-line 42*a*. When the wall 21*a* is inserted in lower tray 21*b* and the notches 49*a* are aligned with the notches 49, the tear line 42*a* of liner wall 21*a* will cross the tear-line 42 of the bottom tray 21*b* and be at a right angle thereto. Tearing the disc 21*a* by the tabs 45*a* and at the perforated line 41*a* will obviously produce the six flaps 51*a*, 52*a*, 53*a*, 54*a*, 55*a* and 56*a* hinged at the respective sides of the scored square 40*a*. If desired, bottom wall 21*a* could be made smaller and inserted into body 10 to rest on the upper surfaces of attaching flanges 14, as shown in FIG. 7.

For shipping and storage, the drum-like containers will preferably be supported by a pallet which is indicated generally by the numeral 60 in FIGS. 1 to 3 and which is preferably made of wood. It may be formed in various ways but is shown as including four main parallel longitudinally extending supports 61 having the four main transverse parallel upper slats 62 secured to the upper surface thereof along with the short slats 63 secured in parallel relationship to and between the innermost slats 62. The slats are all in the same plane to support the bottom of the container and are arranged to provide a central opening or space 64 which is slightly larger than the square 40 at the bottom closure tray 21*b*. Parallel skids 64 are secured to the lower sides of the supports 61 at right angles thereto and at opposite sides of opening 65 to provide for insertion of forks of a lift below the platform of the pallet.

Thus, the container consists mainly of the tubular body 10 composed of the hinged panels 11, the bottom closure consisting of lower cap 21*b* having the hinged flanges 25 and the flat wall 21, and the inner or liner wall 21*a*. Also, the container may have the upper cap 20*a*. The container may be supplied in knocked-down form and all of the parts including the body 10, cap 20*a*, tray 21*b* and wall 21*a* may be in flat condition but will be ready for setting up of the container when desired, the tubular body 10 being almost circular when set up. The pallet 60 will also usually be supplied with the flat container parts for assembly.

In use, the container bottom assembly 20 is first assembled as indicated and as shown in FIGS. 2 and 3 with the liner wall 25*a* inserted within the lower tray 21*b* which has its flanges 25 upturned. The wall 21*a* will be positioned angularly 90° relative to the wall 21 and this orientation will be facilitated by the notches 49*a* and 49 on the respective members. The wall 21*a* will rest on the wall 21. Before the liner wall 21*a* is inserted in the lower cap 21*b*, the tabs 45*a* are bent downwardly and tucked between the inner wall 21*a* and the outer wall 21. The set up multi-sided polygonal tubular container body 10 with its flanges 14 inwardly-turned is then inserted within the upstanding flanges 25 of the lower tray 21*b* and the retaining band 31 is applied to hold the closure assembly 20 and body 10 together. The container body with its bottom closure thus positioned thereon, is rested on the platform of the pallet 60 with the square 40 located over the opening 65 thereof but before this is done the tabs 45 are pulled downwardly so that they will project through the opening 65 in a depending position where they can be reached from below the pallet. The container body and lower closure parts may be fastened to the pallet by staples or large-head nails 66 which pass down through the flanges 14, wall 21*a*, wall 21 and into the slats 62 to hold the assembled container on the pallet in proper relationship to the dispensing opening 65 in the pallet. After filling, the upper cap 20*a* may be positioned on the upper end of the body 10 and be held in place by the hand 31*a*. The frangible areas of the overlying bottom walls 21*a* and 21 are not covered by flanges 14 or any other walls. Thus, the inner surface of such areas is exposed to the weight of the container contents.

To dispense the contents of the contaner, it is merely necessary to support the pallet at a suitable level and open the bottom by rupturing the frangible walls. This is done by first pulling on the depending tabs 45 to tear the disc 21 along the line 42, tear the flaps 51, 52, 53, 54, 55 and 56 apart at the perforated lines 41, and then pulling the flaps downwardly into the pallet opening 65. This will expose the tabs 45*a* of the liner wall 21*a* and by pulling downwardly on these tabs, the wall 21*a* is torn at the tear-line 42*a*, and then the flaps 51*a*, 52*a*, 53*a*, 54*a*, 55*a* and 56*a* are separated at the perforated lines 41*a*, this being aided by the weight of the bulk material in the container. These latter flaps will swing downwardly into position in the opening 60 over the flaps 51, 52, 53, 54, 55 and 56 and will cooperate therewith to provide a downwardly directed dispensing spout on the bottom of the container and positioned within the pallet opening 65. Thus, the frangible double bottom wall arangement at the bottom of the container normally adequately supports the load of the contents but permits successive tearing of the walls 21 and 21*a*, to form a completely-exposed bottom dispensing opening for discharge of the contents of the container. The inner surface of the frangible area of bottom wall 21*a* is exposed to the weight of the container contents which will aid in rupturing that wall when tear strip 42*a* is actuated.

The frangible areas referred to in the previous description have been referred to as square but they could be of other rectangular form. For example, they could be of rectangular form where the length is greater than the width (not shown). In such a case, the opening in the pallet would be of corresponding rectangular form. However, so that the rectangular areas of the two superimposed bottom members would align, even when the tear strips thereof were disposed at right angles, the tear strip in one member would extend along the length of the rectangle and the tear strip in the other would extend across the width of the rectangle.

Figure 8:
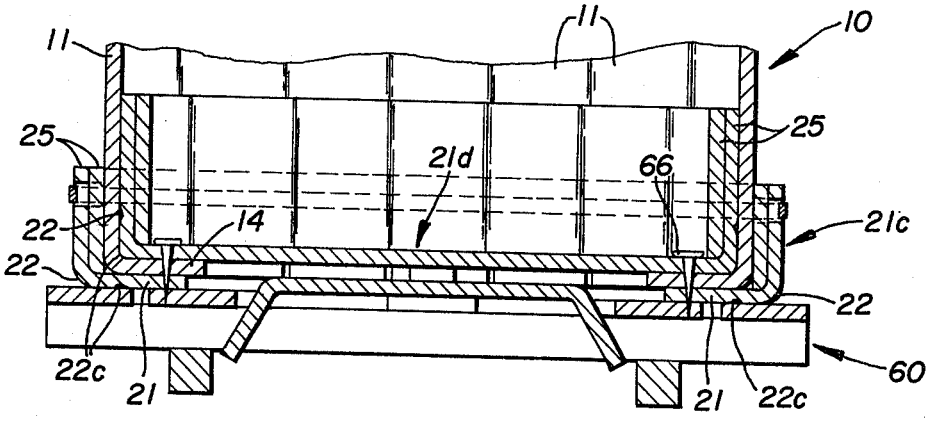

In FIG. 8, a bottom closure arrangement similar to that described is shown except that the bottom cap or tray 21*c* is modified slightly, as compared to tray 21*b*, so that it can be used as both the liner and the outer tray of the bottom. For this purpose, the member 21*c* is provided with additional scored hinge lines 22*c*, inwardly of the previously mentioned score lines 22 of member 21*b*, so that when the flanges 25 are folded upwardly along these score lines, the resulting tray 21*d* will be slightly smaller and can be inserted within the body 10 over the inturned flanges 14 thereof.

Figure 9:
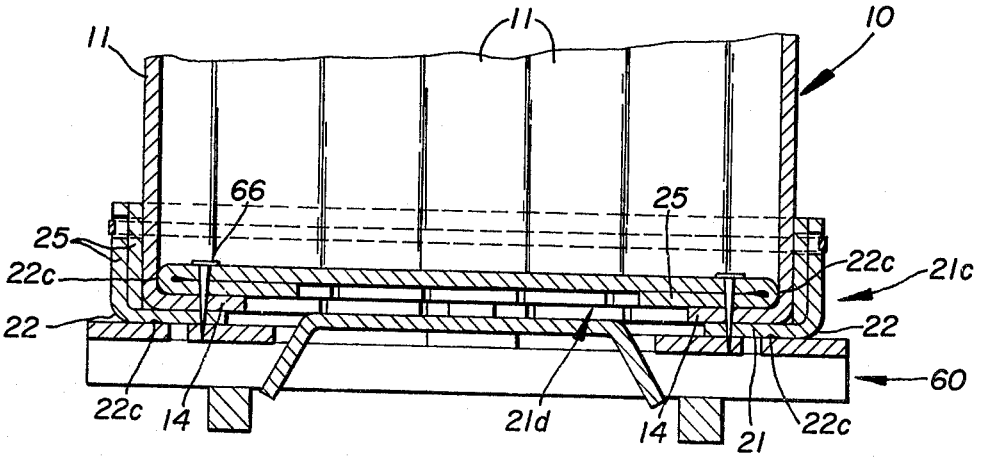

In FIG. 9, the bottom closure arrangement is the same except that the flanges 25 of the member 21*b* are turned inwardly about the score lines 22*c* so that they will lie beneath the bottom of member 21*d* and will rest on the flanges 14. Thus, in this figure the flanges 25 are tucked beneath the inner liner wall member over the flanges 14 and in FIG. 8 they are upstanding within the body 10. With the arrangements of FIGS. 8 and 9, the scored frangible areas in both bottom members would be square.

It will be apparent from the above that this invention provides a drum-like container assembly for shipping, storage and dispensing. The various parts of the assembly are preferably of such structures that it can be supplied in flat knocked-down form but can be set up readily. The bottom closure provides frangible bottoms which can be readily opened by tear-strips to provide a dispensing opening with a dispensing spout.

Having thus described the invention, what is claimed is:

1. A container of fiberboard or the like comprising a tubular body with an open lower end, a bottom closure for the open lower end and including a bottom wall member having a frangible area which is weakened along selected lines to provide flaps which can be separated to form a dispensing opening, a tear-strip cooperating with said bottom wall member to permit tearing of the membe to provide the separated flaps, said frangible area of the bottom wall member having an inner surface completely exposed so that the weight of the container contents will aid in rupturing said wall when the tear strip is actuated to form said opening, said bottom closure including at least two bottom wall members in superimposed relationship, each of said bottom members having said frangible area and a tear-strip cooperating therewith, said frangible areas being superimposed in cooperative relationship, each of the tear-strips extending across a medium line of its respective bottom wall member, the superimposed bottom wall members being so arranged angularly relative to each other that the tear strips are disposed substantially at right angles relatively.

2. A container according to claim 1 in which the selected lines along which each bottom wall member is weakened include score lines arranged substantially in a rectangle bisected by said tear-strip and perforated lines extending angularly from the corners of the rectangle toward said tear strip.

3. A container according to claim 1 in which each tear-strip is provided with depending actuating tabs, the tabs of an upper wall member being tucked between it and the next lower bottom wall member.

4. A container according to claim 1 in which the tubular body has attaching flanges at its lower end extending inwardly into cooperation with the superimposed bottom wall members.

5. A container according to claim 4 in which the tubular body is composed of a plurality of vertically extending panels hinged together at vertical fold lines to provide a multi-sided polygonal tube, said attaching flanges being on the lower ends of the respective panels and being connected thereto at horizontal fold lines.

6. A container according to claim 5 in which the bottom closure includes said superimposed wall members with the lowermost one having a polygonal edge with upstanding flanges connected thereto along fold lines and corresponding in number and position to said vertically extending panels of the tubular body and upwardly over which they extend in overlapping relationship.

7. A container according to claim 6 in which the bottom closure includes an innermost bottom wall member having a polygonal edge complemental to the upstanding flanges of the lower bottom wall into which it is inserted, said attaching flanges of the tubular body resting on one of the bottom wall members.

8. A container according to claim 7 in which the bottom wall member rests on a pallet to facilitate handling of the container, said pallet formed to provide an open area located beneath the lowermost frangible area of the bottom wall member to provide space for receiving the flaps as they swing downwardly to form the dispensing opening.

9. A container according to claim 8 including fastening members extended downwardly through said inwardly extending attaching flanges and bottom wall members into said pallet.

10. A container according to claim 9 in which the innermost bottom wall member is identical with the lowermost one but slightly smaller to fit into said body with its flanges extending upwardly over the inner surface of said panels and with the flanges of the lowermost bottom member extending upwardly over the outer surfaces of said panels.

11. A container according to claim 9 in which the innermost bottom wall member is identical with the lowermost one but has its flanges tucked beneath it to rest on said attaching flanges of the body.

12. A container according to claim 1 including a pallet on which the tubular body rests, said pallet having an open area beneath said frangible area of the bottom wall member to receive the flaps as they swing downwardly to form the dispensing opening.

13. A container of fiberboard or the like comprising a tubular body, a bottom closure for the body including a bottom wall member having a frangible area which is weakened along selected lines to provide flaps which can be separated to form a dispensing opening, a tear-strip cooperating with said bottom wall member to permit tearing of the member to provide the separted flaps, and a second bottom wall member in the form of a liner member resting on the first-named bottom wall member, said liner member having a frangible area like the frangible area of the first bottom wall member superimposed relative thereto and having a similar cooperating tear-strip, each of the tear-strips extending across a medium line of its respective bottom wall member, the superimposed bottom wall members being so arranged angularly relative to each other that the tear lines are disposed substantially at right angles relatively.

14. A container according to claim 18 in which the selected lines along which each bottom wall member is weakened include score lines arranged substantially in a rectangle bisected by said tear-strip and perforated lines extending angularly from the corners of the rectangle toward said tear-strip.

15. A container according to claim 14 in which the each tear-strip is provided with depending actuating tabs, the tabs of the innermost wall member being tucked between it and the adjacent lower bottom wall member.

16. A container according to claim 13 including a pallet on which the tubular body rests, said pallet having an open area beneath said frangible area of the bottom wall member to receive the flaps as they swing downwardly to form the dispensing opening.

* * * * *

UNITED STATES PATENT OFFICE

CERTIFICATE OF CORRECTION

Patent No. 3,972,454 Dated August 3, 1976

Inventor(s) THOMAS E. CROLEY

It is certified that error appears in the above-identified patent and that said Letters Patent are hereby corrected as shown below:

Name of assignee to read - CORCO, INC.- instead of " COMCO, INC."

Claim 14, line 1, "18" to read -13-.

Signed and Sealed this

Seventh Day of December 1976

[SEAL]

*Attest:*

RUTH C. MASON
*Attesting Officer*

C. MARSHALL DANN
*Commissioner of Patents and Trademarks*